United States Patent [19]

Palmen

[11] 4,456,262

[45] Jun. 26, 1984

[54] VIDEO SHOOTING SYSTEM

[76] Inventor: Georg Palmen, Aurinstrasse 52, D 4040 Neuss, Fed. Rep. of Germany

[21] Appl. No.: 435,076

[22] Filed: Oct. 18, 1982

[30] Foreign Application Priority Data

Oct. 21, 1981 [DE] Fed. Rep. of Germany ..... 3141798

[51] Int. Cl.[3] ..... F41J 9/14

[52] U.S. Cl. ..... 273/358; 434/20

[58] Field of Search ..... 273/358; 434/20, 21, 434/22

[56] References Cited

U.S. PATENT DOCUMENTS 3,849,910 11/1974 Greenly ..... 434/22

FOREIGN PATENT DOCUMENTS 2346588 3/1975 Fed. Rep. of Germany ..... 273/358

*Primary Examiner*—William H. Grieb

*Attorney, Agent, or Firm*—Wood, Dalton, Phillips, Mason & Rowe

[57] ABSTRACT

Video shooting system in which a first shooting room (1) has therein a first target area (11) and a second shooting room (2) has therein a second target area (21). The scene observed in first room (l) by a video camera (15) therein is projected by a first projector (17) in second shooting room (2) on the second target area; the scene a second video camera (25) observes in second shooting room (2) is projected by a second video projector in the first shooting room on said first target area. The invention is useful for showing true-to-nature scenes and events for life-like target practice.

11 Claims, 2 Drawing Figures

VIDEO SHOOTING SYSTEM

The instant invention relates to a video shooting system.

It is customary to this date to conduct target practice with hand weapons, rifles, submachine and machine guns by firing at stationary targets—such as discs—on practice ranges. This type of target practice is not life-like because most of the targets against which a person may have to use a weapon in reality will be moving.

Shooting systems have been known in which an optical projector projects an image of a target on a target area, with the image being movable across the target area by horizontally and vertically moving the projector. This type of system has been disclosed by West German Offenlegungsschrift No. 23 46 588, for example.

It is the object of the invention to provide a shooting system which for target practice enables unpredictable events or scenes involving at least two persons to be enacted in a simple yet realistic manner, with the two marksmen themselves being part of the presentation.

This object is achieved by a shooting system as specified above having a first shooting room, a first target area in the first shooting room, a first video camera in the first shooting room, and a first video projector for projecting a scene on the first target area. The system further includes a second shooting room having a second target area, a second video camera and a second video projector for projecting a scene on the second target area. The second video projector is connected and responsive to the first video camera and the first video projector is connected and responsive to the second video camera.

As a consequence, the image of a marksman in the first shooting room, may serve as a target for a marksman in the second shooting room and vice versa.

An essential advantage of the instant invention is that it enables totally true-to-life target practice to be conducted, involving at least two marksmen and their reaction to unpredictable events. For example, it is entirely possible with the inventive shooting system to re-enact or show for target practice in a true-to-life and completely harmless manner a duel involving the encounter of two shooters.

Also, the inventive system has the advantage of being extremely simple.

Another advantage of the instant invention is that after an event has been enacted that event may be repeated or reproduced accurately so that observers may ascertain at which time the person or persons involved in the scene reacted to a given event. The hit score may be reproduced by conventional means.

In order that the invention may be understood, the features and further developments thereof will now be explained in detail with reference to the appended drawing.

Figure 1:
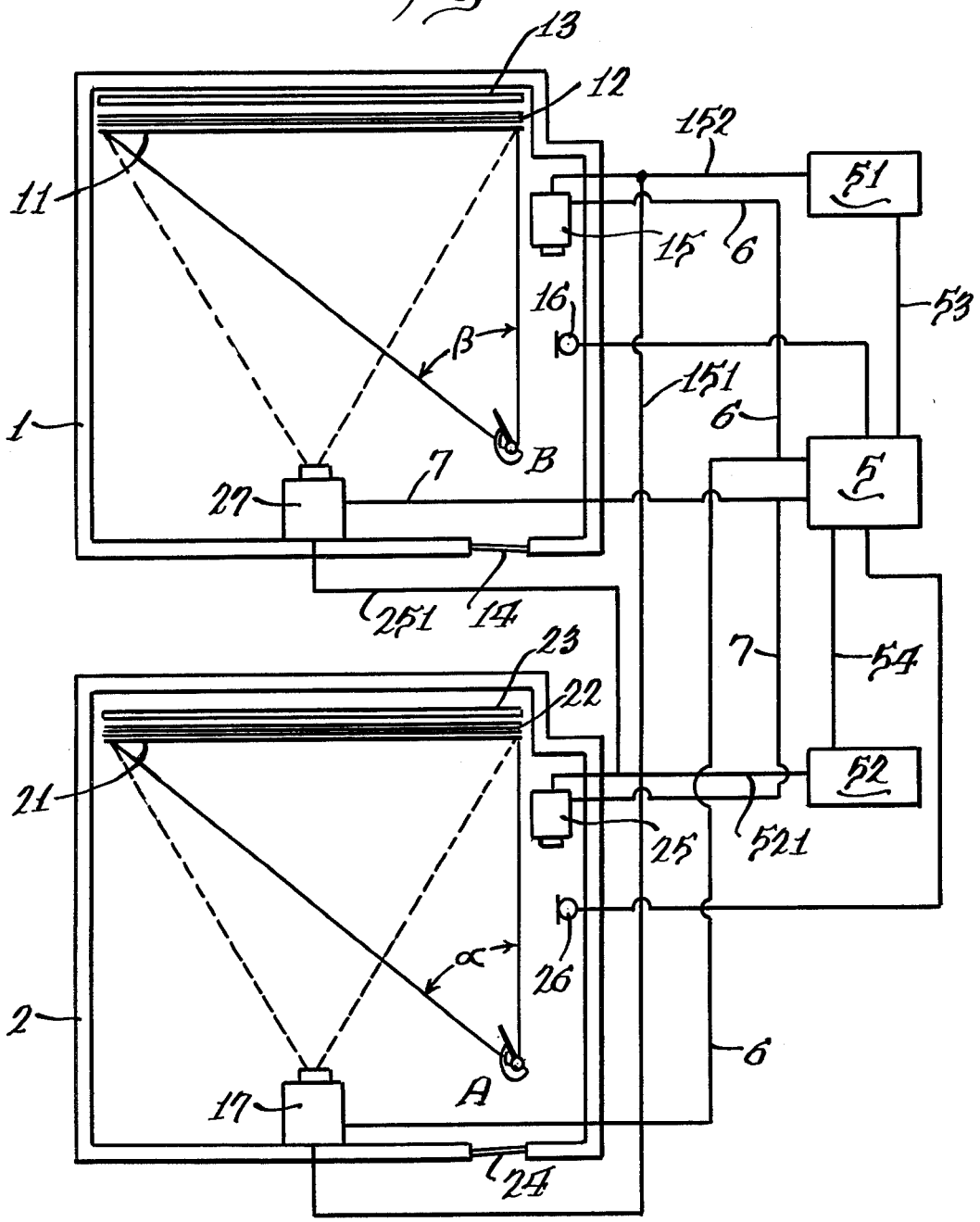
Figure 2:
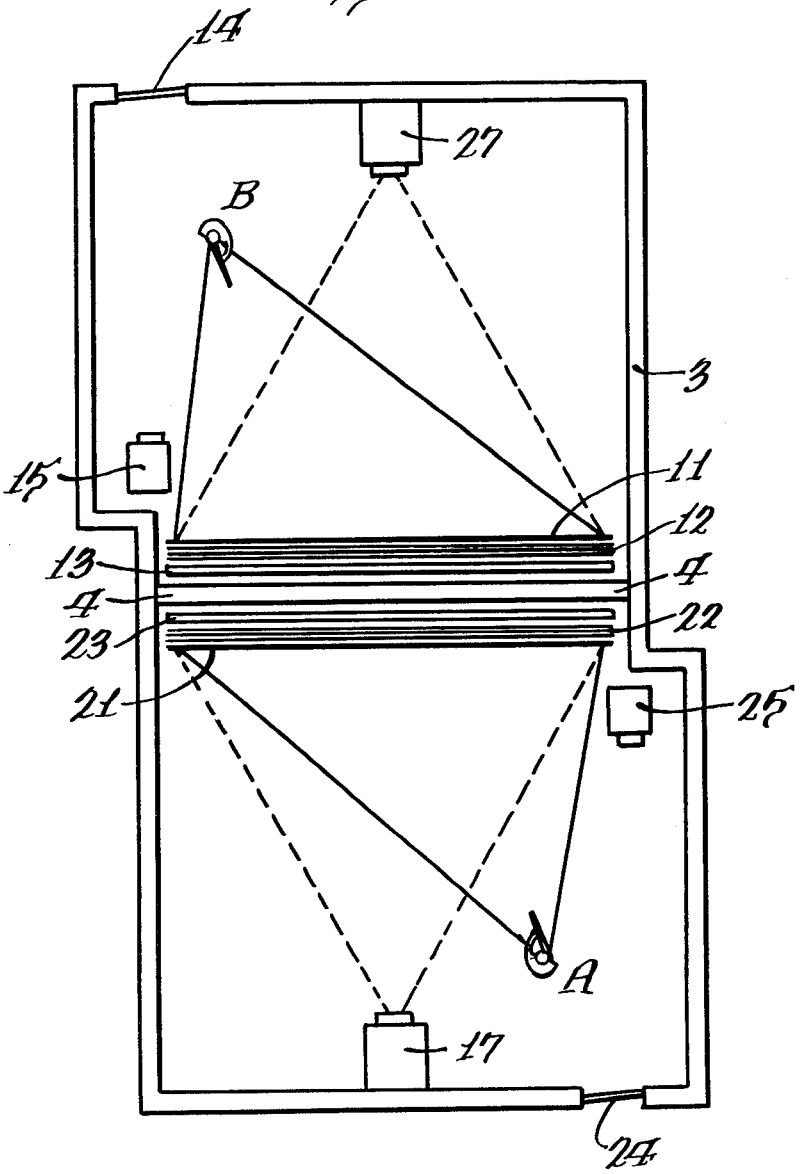

FIG. 1 shows in a schematic manner a shooting system set up in accordance with the invention; and FIG. 2 shows another embodiment of the inventive shooting system.

FIG. 1 shows at 1 a first shooting room having a projectile-intercepting backstop 12 provided with a target area 11 on its front surface. Behind backstop 12 may be provided at a given distance a wall 13 of sheet steel having a noise-abating coating thereon. A marksman B standing in the shooting room can observe under an observation angle $\beta$ the movements taking place on the target area, which movements are projected onto target area 11 by means of a suitable video projector 27. In order to generate on target area 11 a highly visible image, it preferrably comprises an elastic rubber web held in a frame and having on its side facing the video projector 27 a paste-like and plastically deformable marking layer onto which the image may be projected and of which the color contrasts with that of the web. Preferrably, a light color of the markiing layer is obtained by admixing titanium dioxide. The projectile from a shot fired by marksman B will displace the material of the marking layer at the point of impact, causing the rubber web of target area 11 to be exposed, which may be darker in color, for instance. The projectile will penetrate the rubber web and leave in it a small hole which closes immediately, owing to the rubber material's elasticity, so that the hit will be visible as a block dot.

Also, there is provided in room 1 a video camera 15 which is directed on marksman B. The scene which camera 15 observes is projected by a video projector 17 in a second room 2 on another target area 21 located in room 2 in front of a backstop 22. Basically, room 2 is equipped the same way as 1. Marksman A in room 2 is observed by video camera 25, of which the video image signal is transmitted to video projector 27 to be projected on target area 11.

Line 151 links video camera 15 with video projector 17, and line 251 links video camera 25 with video projector 27.

The system described above enables marksman A in room 2 to observe marksman B and his movements on target area 21 in room 2; conversely, marksman B in room 1 will see marksman A and his movements on target area 11 in room 1. Next, the invention will be explained by way of a simple example. It is assumed that marksmen A and B are "friendly", meaning that neither marksman A seen by camera 25 nor marksman B seen by camera 15 has drawn his weapon. If, now, one of the marksmen—for example, marksman B—draws his weapon, camera 15 will observe the event and cause it to be projected by video projector 17 on target area 21 in front of marksman A. Marksman A will be able to react instantly and to fire a shot at the image of marksman B which is projected on target area 21. Control and storage means—to be explained in detail below—are provided to enable the entire event to be repeated to ascertain accurately whether marksman A in fact drew his weapon in time in response to the threat posed by marksman B, and whether the shot he fired did in fact strike the projected image of marksman B. In case marksman B fired a shot as well, it is possible to ascertain subsequently whether marksman B struck the projected image of marksman A. Also, the sequence of the shots fired by marksmen A and B may be determined.

The inventive shooting system enables a great variety of totally different scenes to be enacted in a true-to-life manner—such as a duel: with marksman A turning his back on camera 25 and marksman B turning his back on camera 15 in the starting position, an optical or acoustical signal is transmitted to both marksmen at the same time, in response to which both of them turn 180° so as to face the corresponding camera. Either marksman will be able to recognize the other's picture on his target area and to react accordingly.

Additionally, it is possible in target practice for room 1 to be empty to start with. In that case, camera 15 transmits to marksman A in room 2 the image of door 14, for example, which is closed. If, now, a person enters room 1 through door 14, marksman A must decide on the basis of the image transmitted to target area 21 whether that person poses a threat or not, and he must react accordingly.

By means of the inventive shooting system, any desired scene or event may be enacted and shown for shooting or target practice. Such scenes or events may in fact involve more than one shooter or marksman in either room.

As is evident in FIG. 2, the inventive shooting system may be set up in a single room 3 having a partition 4 to divide room 3 into two compartments each of which is equipped as described above under reference to FIG. 1.

Hereafter, there will now be described under reference to FIG. 1 the control system by means of which enacted scenes or events may be repeated or reproduced and the reaction of marksmen A and B be evaluated.

To start with, control system 5 simultaneously energizes through lines 6, 7 the cameras 15, 25 and the associated video projectors 17, 27, respectively. As a consequence, the image seen by each camera in its room will be proejcted on the target area of the respective other room. The image observed by camera 15 is stored by means of a video recorder 51 (line 152), which control system 5 energizes at the same time as camera 15. Correspondingly, the image seen by camera 25 is recorded by video recorder 52 (line 521), which control system 5 energizes at the same time as camera 25. The video recorders are started through lines 53, 54, respectively. At the same time it energizes cameras 15, 25, video projectors 17, 27 and the video recorders, control system 5 energizes an audio recording device (not shown) which records the sequence of shots which microphones 16, 26 transmit to control system 5. Preferably, the audio recording device uses separate tracks for each room. At the end of the event, video-recorders 51, 52 and the audio recording device are stopped, reset and restarted simultaneously by control system 5 for playback. The events recorded by video recorder 51 will now be seen on target area 21 of room 2, while the events recorded by video recorder 52 will be seen on target area 11 of room 1. The first report or crack recorded by the audio recording device, which was caused by the shot fired first, automatically stops video recorders 51, 52 and the audio recording device. By energizing indicator lights (not shown) in rooms 1 and 2, marksmen A and B may be advised who fired the first—or whichever—shot. Each indicator light is associated with a specific recording track. On the basis of the entry hole of the projectile and the still picture projected at that time by the respective video projector, a marksman will be able to recognize precisely whether the shot he fired was a hit or not. Thereafter, re-actuation of control system 5 causes video recorders 51, 52 and the audio recording device to be re-started. The second report or crack recorded by the audio recording device as having been produced by the second shot fired causes the audio recording device and the video recorders to be stopped again. An indicator light (not shown) will signal to the other marksman that the situation then shown on the target area existed when it was his shot that was fired.

I claim:

1. A video shooting system comprising:

a first shooting room;

a first target area in said first shooting room;

a first video camera in said first shooting room;

a first video projector for projecting a scene on said first target area;

a second shooting room;

a second target area in said second shooting room;

a second video camera in said second shooting room; and a second video projector for projecting a scene on said second target area;

said second video projector being connected and responsive to said first video camera and said first video projector being connected and responsive to said second video camera.

2. The video shooting system of claim 1 wherein each of said target areas comprise a frame; an elastic rubber web in said frame and having a surface facing the associated video projector and including a plastically deformable paste-like marking layer adapted to one of said scenes projected thereon.

3. The video shooting system of claim 1 and further including first and second video recorders respectively associated with (a) said first video camera and said second video projector, and (b) said second video camera and said first video projector; audio recording means, including first and second microphones, for recording noises in said first and second shooting rooms; and control means for starting, stopping, resetting and restarting said first and second video recording means and said audio recording means, said video recorders being adapted to be stopped after ech start or restart by the report of a shot recorded by said audio recording means.

4. The video shooting system of claim 2 and further including first and second video recorders respectively associated with (a) said first video camera and said second video projector, and (b) said second video camera and said first video projector; audio recording means, including first and second microphones, for recording noises in said first and second shooting rooms; and control means for starting, stopping, resetting and restarting said first and second video recording means and said audio recording means, said video recorders being adapted to be stopped after each start or restart by the report of a shot recorded by said audio recording means.

5. The video shooting system of claim 3 wherein said audio recording means includes a pair of recording tracks, one for each of said microphones, and further including indicating means for said shooting rooms actuatable in response to a report recorded on either of said recording tracks.

6. The video shooting system of claim 4 wherein said audio recording means includes a pair of recording tracks, one for each of said microphones, and further including indicating means for said shooting rooms actuatable in response to a report recorded on either of said recording tracks.

7. The video shooting system of claim 5 wherein said indicating means comprise indicating lights.

8. The video shooting system of claim 6 wherein said indicating means comprise indicating lights.

9. The video shooting system of claim 2, 3, 4, 5, 6, 7 or 8 wherein said first video camera is disposed to view a desired portion of said first shooting room for projection on said second target area, and said second video camera is disposed to view a desired portion of said second shooting room for projection on said first target area.

10. The video shooting system of claim 2, 3, 4, 5, 6, 7 or 8 wherein said first and second shooting rooms are defined by a single shooting room and a partition dividing said single shooting room.

11. The video shooting system of claim 9 wherein said first and second shooting rooms are defined by a single shooting room and a partition dividing said single shooting room.

* * * * *